US005515654A

United States Patent [19]

Anderson

[11] Patent Number: 5,515,654

[45] Date of Patent: May 14, 1996

[54] TELESCOPIC BOOM APPARATUS

[76] Inventor: Edward E. Anderson, Rte. 4, Box 972, Salem, Mo. 65560

[21] Appl. No.: 333,415

[22] Filed: Nov. 2, 1994

[51] Int. Cl.[6] ..... B66C 23/00

[52] U.S. Cl. ..... 52/118; 52/121; 52/632; 212/231; 212/264; 212/350

[58] Field of Search ..... 52/632, 118, 121; 212/230, 231, 264, 350

[56] References Cited

U.S. PATENT DOCUMENTS

| | | | |
|---|---|---|---|
| 1,281,179 | 10/1918 | Levalley et al. | 52/118 X |
| 3,082,881 | 3/1963 | Wieger | 212/350 |
| 3,587,886 | 6/1971 | Gano | 52/632 X |
| 3,836,011 | 9/1974 | Sakamoto et al. | 212/350 X |
| 3,913,756 | 10/1975 | Barron et al. . | |
| 3,954,196 | 5/1976 | Gano . | |
| 4,016,688 | 4/1977 | Tiffin et al. . | |
| 4,162,873 | 7/1979 | Smith, Jr. . | |
| 4,169,338 | 10/1979 | Eik | 52/118 |
| 4,239,442 | 12/1980 | Maynard . | |
| 4,257,201 | 3/1981 | Landolt et al. | 52/632 X |
| 4,728,249 | 3/1988 | Gano . | |
| 5,020,323 | 6/1991 | Hurlimann . | |
| 5,158,189 | 10/1992 | Watson et al. | 212/350 |
| 5,267,824 | 12/1993 | Kishi . | |

*Primary Examiner*—Carl D. Friedman
*Assistant Examiner*—Aimee E. McTigue
*Attorney, Agent, or Firm*—Hovey, Williams, Timmons & Collins

[57] ABSTRACT

A telescopic boom including an elongated hollow outer boom, an elongated inner boom telescopically received within the outer boom, and guidance structure for guiding the inner boom for telescopic movement is provided. The guidance structure includes a plurality of guide rails attached to the interior corners of the outer boom, a first roller assembly attached to one end of the inner boom, and a second roller assembly attached to one end of the outer boom. The first roller assembly includes a plurality of wheels mounted on axles for engaging the guide rails. Each of the wheels includes an arcuate rail-engaging portion which presents a radius of curvature equal to the radius of curvature of the guide rails. The second roller assembly includes a pair of roller bars positioned on opposed sides of one end of the outer boom for guiding the inner boom during telescopic movement. Each of the roller bars extends transverse to the longitudinal axis of the outer boom and is rotatably mounted on an elongated shaft.

3 Claims, 4 Drawing Sheets

(PIOR ART)

TELESCOPIC BOOM APPARATUS

BACKGROUND OF THE INVENTION

1. Field of the Invention

The present invention is related to telescopic boom devices, and more particularly to an improved telescopic boom guidance assembly for guiding the boom during telescopic movement.

2. Description of the Prior Art

Telescopic boom devices are commonly used in applications requiring rapid extension and retraction of a working tool. For example, telescopic booms are commonly used in underground mining operations for working on the ceiling or upper surface of the mine. These telescopic booms are provided with scaling tools which knock down loose deposits from the ceiling of the mine to stabilize the mine before workers are allowed to enter.

Telescopic boom devices typically include an elongated hollow outer boom, an elongated inner boom telescopically received within the outer boom, and a guidance system for guiding the inner boom for telescoping movement in and out of the outer boom. The guidance system typically includes a plurality of wheels welded to one end of the inner boom. The wheels engage a track or guide rail positioned in the outer boom for guiding the inner boom during telescopic movement. Prior art guidance systems also typically include a plurality of wheels welded to one end of the outer boom for engaging the outer surface of the inner boom during telescopic movement.

Prior art telescopic booms suffer from limitations which limit their utility. For example, it has been discovered in the industry that the guidance systems of prior art telescopic booms commonly fail. In particular, the wheels positioned on the inner booms frequently slide off of the truck or guide rails, thus rendering the telescopic boom inoperable. There are several limitations in the design of prior art telescopic boom guidance systems which cause this problem. For example, the wheels of prior art guidance systems present rail-engaging surfaces which are generally flat or have a radius of curvature which is significantly greater than the radius of curvature of the guide rails positioned in the outer boom. This results in limited surface contact between the wheels and the guide rails and causes the wheels to slide off of the guide rails.

Another limitation of prior art guidance systems is that their wheels only engage a small portion of the guide rails and do not include structure for maintaining the engagement between the wheels and the guide rails.

Another limitation of prior art guidance systems is that the wheels attached to the outer boom engage only a small portion of the outer surface of the inner boom. Accordingly, these wheels frequently slide off of the outer surface of the inner boom and render the telescopic boom inoperable.

Another limitation of prior art guidance systems is that the axles or shafts supporting the wheels are typically permanently welded to the inner and outer booms and thus are difficult to repair and replace.

Another limitation of prior art guidance systems is that they are difficult to adjust. Due to the harsh working environment, the inner booms often become deformed during normal operation. For example, the outer surface of the inner boom may become dented or may expand at certain points due to metal strain. These deformities cause alignment problems between the wheels of the guidance system and the guide rails. To realign the wheels to compensate for the deformities, the wheels must be cut from the inner boom, realigned and re-welded.

The limitations described above limit the utility of prior art telescopic booms. In particular, prior art telescopic booms commonly breakdown and thus require frequent repair. Due to their large size, telescopic booms typically must be removed from the mining site to repair. This results in lost productivity, increased costs, and shortened equipment life.

Accordingly, there is a need for an improved telescopic boom which overcomes the limitations of the prior art. More particularly, there is a need for a telescopic boom having a guidance system which more effectively maintains the telescopic engagement between the inner boom and the outer boom.

OBJECTS AND SUMMARY OF THE INVENTION

In view of the limitations in prior art telescopic booms discussed above, it is an object of the present invention to provide an improved telescopic boom which more effectively maintains the telescopic engagement between the inner boom and the outer boom.

It is another object of the present invention to provide a telescopic boom including a roller assembly which has an arcuate rail-engaging portion presenting a radius of curvature which approximates the radius of curvature of the guide rails positioned in the outer boom.

It is another object of the present invention to provide a telescopic boom including a roller assembly which engages a relatively large portion of the guide rails.

It is another object of the present invention to provide a telescopic boom including structure for maintaining the engagement between the roller assembly and the guide rails.

It is another object of the present invention to provide a telescopic boom including a roller assembly which can be easily adjusted.

In accordance with these and other objects evident from the following description of a preferred embodiment of the invention, an improved telescopic boom is provided which more effectively maintains the telescopic engagement between the inner boom and the outer boom. The preferred telescopic boom broadly includes an elongated hollow outer boom, an elongated inner boom telescopically received within the outer boom, and a guidance system which includes structure for preventing the inner boom from sliding off of the guide rails.

In more detail, the outer boom is formed of tubular steel and presents a rectangular cross section. The outer boom has opposed axial ends and a hollow passageway extending therebetween.

The inner boom is telescopically received within the outer boom and is also formed of tubular steel presenting a rectangular cross section. The inner boom is telescopically extended or retracted relative to the outer boom by a conventional hydraulic cylinder or gear device mounted on a truck or tractor.

The guidance structure includes a plurality of guide rails attached to the interior corners of the outer boom, a first roller assembly attached to one end of the inner boom for engaging the guide rails, and a second roller assembly attached to one end of the outer boom for engaging the outer surface of the inner boom during telescopic movement.

The guide rails are formed of elongated steel rods and extend parallel to the longitudinal axis of the outer boom. Each of the guide rails presents an arcuate wheel-engaging portion having a specific radius of curvature. The first roller assembly includes a plurality of wheels mounted on axles for engaging the guide rails. Each of the wheels includes an arcuate rail-engaging portion which presents a radius of curvature approximating the radius of curvature of the guide rails. Each of the wheels also includes a generally annular lip portion extending tangentially from the arcuate rail-engaging portion for maintaining the engagement between the wheels and the guide rails.

At least two of the wheels of the first roller assembly are mounted on axles having eccentric axes. When the eccentric axles are rotated, the location of the arcuate rail-engaging portions of the wheels are shifted relative to the guide rails. This allows the guidance system to be adjusted without removing and/or disassembling the roller assemblies. The wheels can be repositioned relative to the guide rails by simply rotating these axles.

The second roller assembly includes a pair of roller bars positioned on opposed sides of one end of the outer boom for engaging and guiding the inner boom during telescopic movement. Each of the roller bars extends transverse to the longitudinal axis of the outer boom and is rotatably mounted on an elongated shaft. A pair of axially opposed flange members are positioned on the ends of the shaft for engaging the corners of the inner boom during axial telescopic movement.

One of the roller bars is rotatably mounted about a shaft which presents an eccentric axis. When the eccentric shaft is rotated, the location of the roller bar is shifted relative to the inner boom. This allows the guidance system to be adjusted without removing and/or disassembling the roller bar.

By providing the above described construction, numerous advantages are obtained. For example, by providing wheels which each include an arcuate rail-engaging portion presenting a radius of curvature equal to the radius of curvature of the guide rails, the wheels more securely engage the guide rails. Additionally, by providing wheels which each include a generally annular lip portion, a greater surface area of the guide rails is enveloped by the wheels of the roller assembly. Accordingly, the roller assembly more securely engages the guide rails.

Additionally, by providing several of the wheels of the first roller assembly and one of the roller bars of the second roller assembly with eccentric axles and shafts, the guidance system can be more easily adjusted to provide proper alignment of the inner boom relative to the outer boom.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
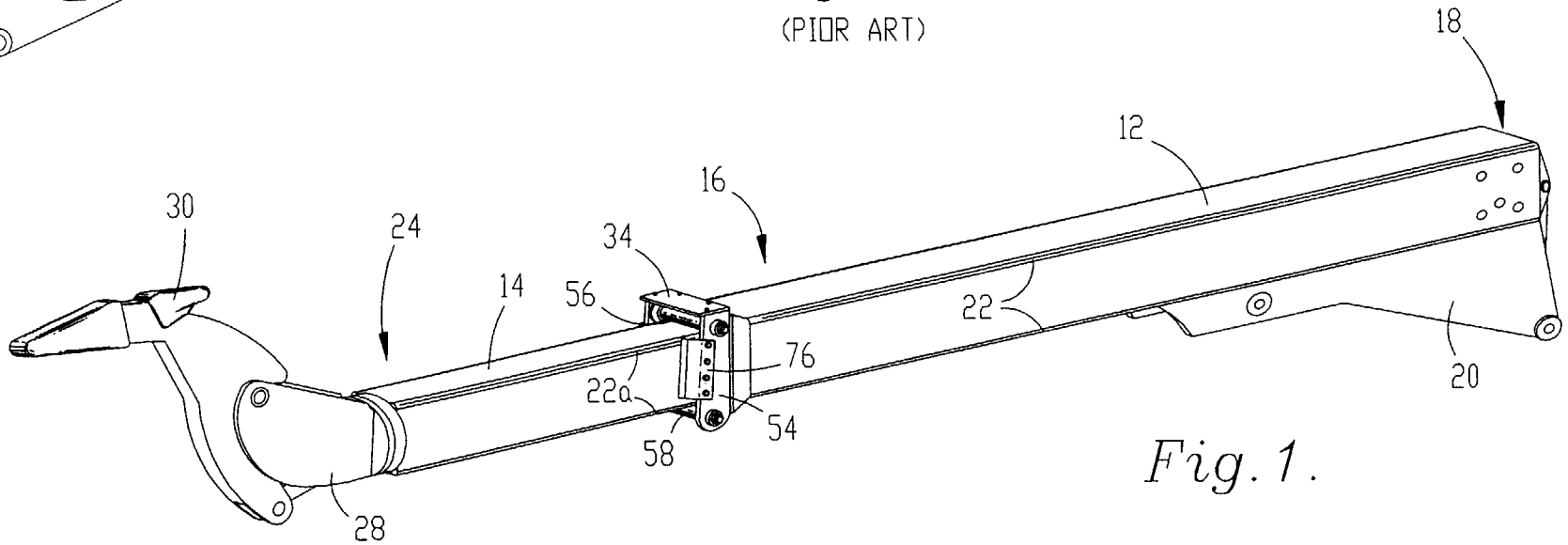
FIG. 1 is a perspective view of a telescopic boom apparatus constructed in accordance with the preferred embodiment.

Turning now to the drawing figures, and particularly FIG. 1, a telescopic boom apparatus constructed in accordance with the preferred embodiment of the present invention is illustrated. The preferred telescopic boom broadly includes an elongated hollow outer boom 12, an elongated inner boom 14 telescopically received within the outer boom 12, and guidance structure for guiding the inner boom 14 for telescoping movement in and out of the outer boom 12.

In more detail, the outer boom 12 is formed of tubular steel and presents a rectangular cross section. The outer boom 12 has opposed axial distal and proximal ends 16 and 18 and a hollow passageway extending therebetween. Attachment plates 20 are secured to the proximal end 18 of the outer boom 12 for coupling the outer boom 12 to a truck or a tractor. As those skilled in the art will appreciate, the truck or tractor is provided with conventional hydraulic cylinders or gear devices for telescopically extending or retracting the inner boom 14 relative to the outer boom 12.

The inner boom 14 is telescopically received within the outer boom 12 and is configured for axial telescopic movement about the longitudinal axis of the outer boom 12 (see FIG. 1). The inner boom 14 is formed of tubular steel and presents a rectangular cross section. The inner boom 14 has axially opposed distal and proximal ends 24 and 26. The distal end 24 has walls defining an opening for receiving a conventional tool barrel 28. The tool barrel 28 has structure for coupling with any suitable tool such as a scaling tool 30 or a scraper for dislodging loose rock deposits from the ceiling of a mine. As those skilled in the art will appreciate, the proximal end 26 of the inner boom 14 is coupled to a hydraulic cylinder or gear device on the truck or tractor for telescopically extending or retracting the inner boom 14 relative to the outer boom 12.

Figures 2, 3, 4, 5:
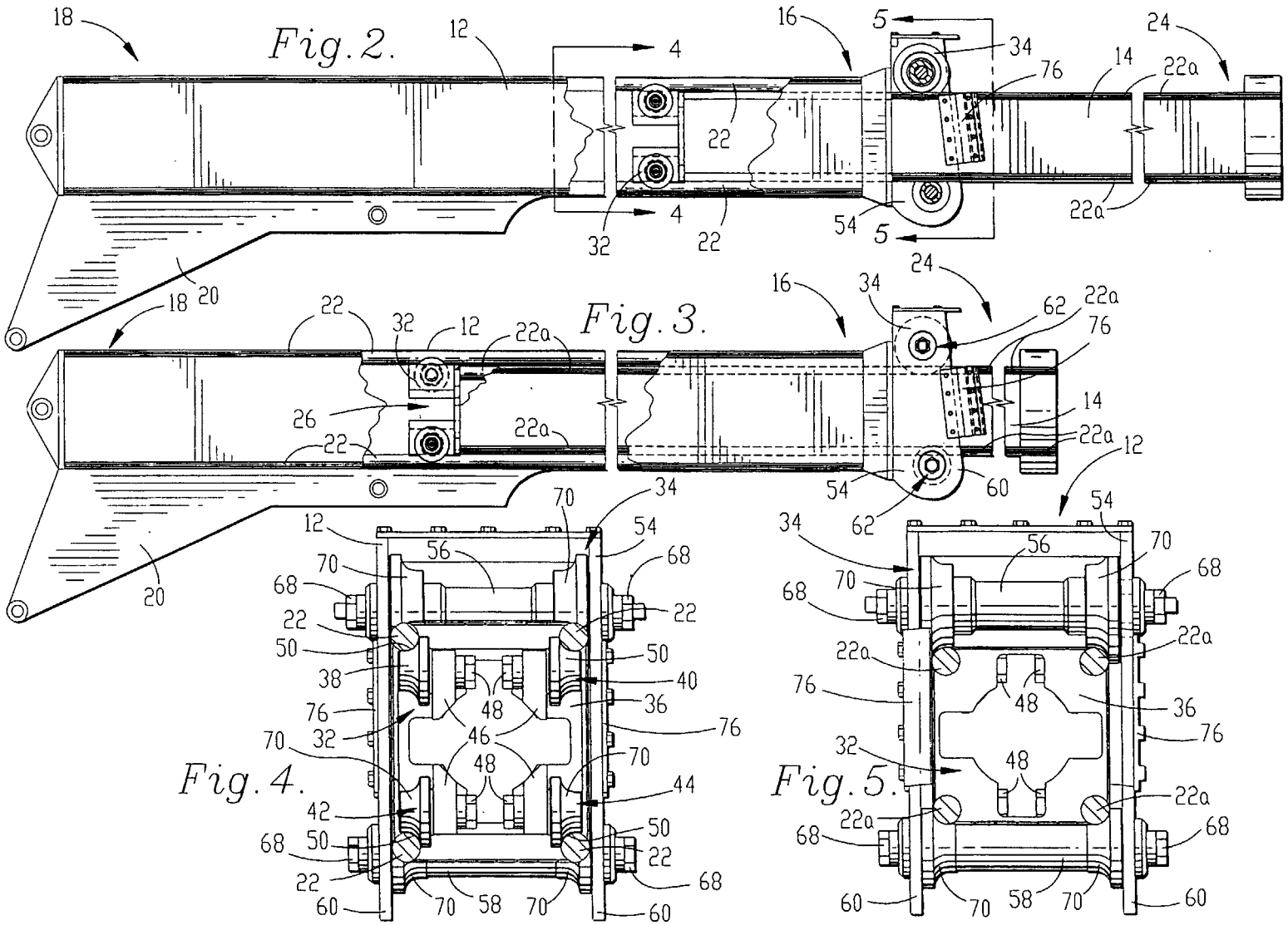
FIG. 2 is a side elevational view of the apparatus illustrating the inner boom partially extended relative to the outer boom.
FIG. 3 is a side elevational view of the apparatus illustrating the inner boom retracted relative to the outer boom.
FIG. 4 is a sectional view of the apparatus taken along line 4—4 of FIG. 2.
FIG. 5 is a sectional view of the apparatus taken along line 5—5 of FIG. 2.

The guidance structure is provided for telescopically guiding the inner boom 14 in and out of the outer boom 12. As best illustrated in FIGS. 2 and 3, the guidance structure broadly includes a first set of guide rails 22 attached to the interior corners of the outer boom 12, a second set of guide rails 22*a* secured to the inner boom 14, a first roller assembly 32 attached to the proximal end 26 of the inner boom 14 for engaging the guide rails 22, and a second roller assembly 34 attached to the distal end 16 of the outer boom 12 for engaging the guide rails 22*a* during telescopic movement.

The elongated guide rails 22 are attached to the interior corners of the outer boom 12 and extend the entire longitudinal length of the outer boom 12. The guide rails 22 are formed of elongated steel rods and each presents an arcuate wheel-engaging portion having a specific radius of curvature. In preferred forms, the wheel-engaging portions of the guide rails 22 present a radius of approximately 1.25".

The first roller assembly 32 is attached to the proximal end 26 of the inner boom 14 and is configured for engaging the guide rails 22 attached to the outer boom 12. As illustrated in FIG. 4, the first roller assembly 32 includes a support frame 36 and a plurality of wheels 38, 40, 42 and 44 rotatably mounted to the support frame 36. The support frame 36 is welded or bolted to the proximal end 26 of the inner boom 14 and is formed of steel. The support frame 36 presents a rectangular cross section having approximately the same dimensions as the cross section of the inner boom 14. The support frame 36 includes four post members 46 extending parallel to the longitudinal axis of the inner boom 14. Each post member 46 includes a slot therein for coupling with the wheels 38, 40, 42 and 44 as described below.

The wheels 38, 40, 42 and 44 are configured for engaging the guide rails 22 positioned in the outer boom 12. The wheels 38, 40, 42 and 44 are rotatably mounted on axles 48 extending through the slots of the post members 46. Each of the wheels 38, 40, 42 and 44 includes an arcuate rail-engaging portion 50 for engaging the corresponding wheel-engaging portions of guide rails 22. The arcuate rail-engaging portion 50 presents a radius of curvature approximately equal to the radius of curvature of the arcuate wheel-engaging portions of the guide rails 22.

Figure 14:
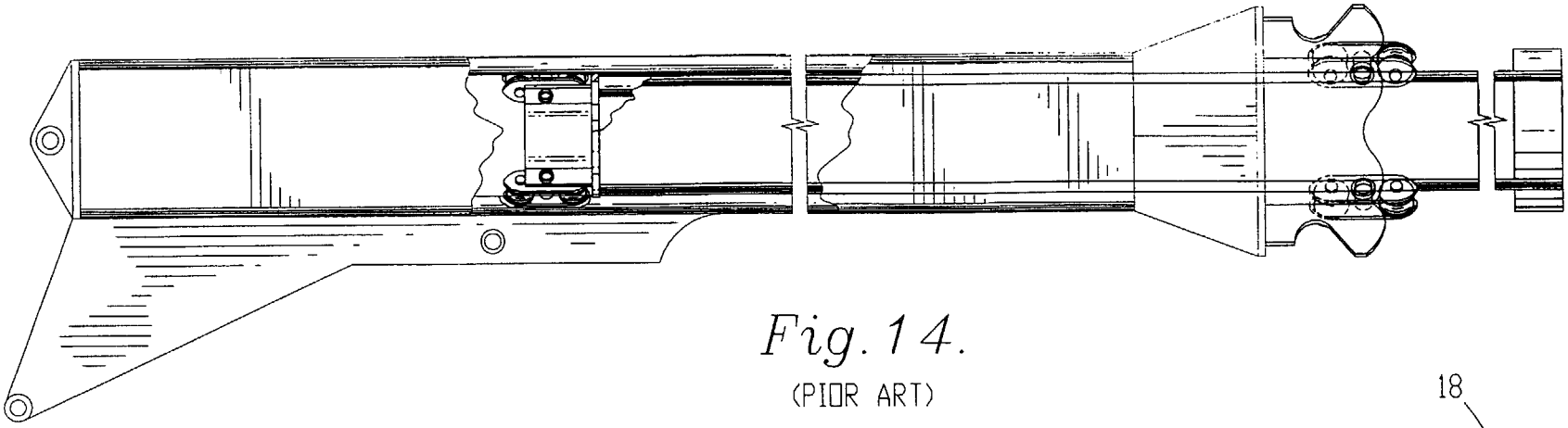
FIG. 14 is an illustration of a prior art telescopic boom.
Figure 16:
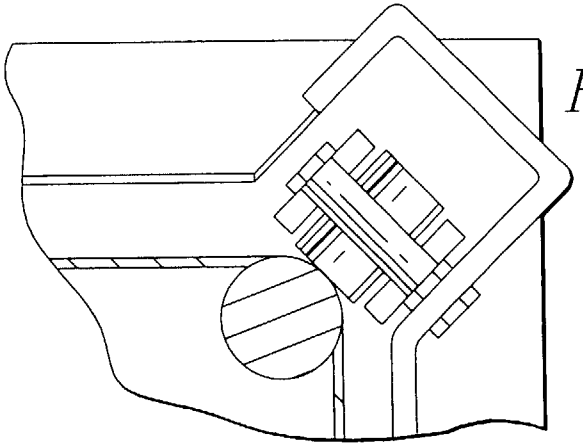
Fig. 16. (PRIOR ART)
FIG. 16 is an enlarged front elevational view of a portion of the prior art telescopic boom illustrated in FIG. 14.

In contrast, as illustrated in FIGS. 14 and 16, prior art roller assemblies include wheels which present rail-engaging surfaces which are generally flat. Accordingly, these prior art wheels frequently slide off of their guide rails and disable the boom apparatus.

Returning to the description of the present invention, the preferred rail-engaging portions 50 of the wheels 38, 40, 42 and 44 present a radius of curvature of approximately 1.25" which is identical to the radius of curvature of the guide rails 22. With this configuration, the arcuate rail-engaging portions 50 of the wheels 38, 40, 42 and 44 engage a full quadrant of the surface area of the guide rails 22. Thus, the wheels 38, 40, 42 and 44 securely engage the guide rails 22 during axial telescopic movement of the inner boom 14.

Figure 7:
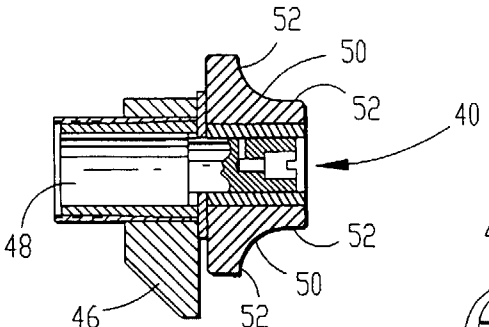
FIG. 7 is a sectional view of one of the wheels of the first roller assembly mounted on an eccentric axle.
Figure 6:
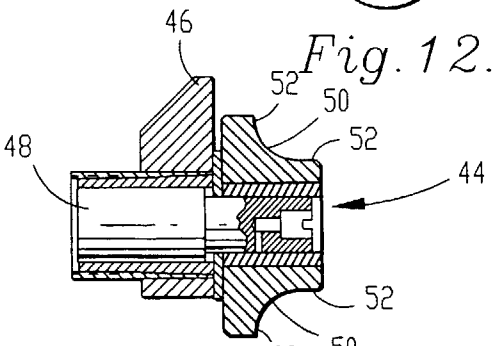
FIG. 6 is a sectional view of one of the wheels of the first roller assembly mounted on a concentric axle.

As best illustrated in FIGS. 6 and 7, each of the wheels 40 and 44 also includes a pair of generally annular lip portions 52 extending tangentially from each end of the arcuate rail-engaging portions 50. Although not illustrated in FIGS. 6 and 7, wheels 38 and 42 are substantially identical to wheels 40 and 44. The lip portions 52 envelop a portion of the guide rails 22 for maintaining the engagement between the wheels 38, 40, 42 and 44 and the guide rails 22.

In contrast, as illustrated in FIGS. 14 and 16, prior art roller assemblies include wheels which have no structure for maintaining the engagement between the wheels and the guide rails. Accordingly, the wheels of prior art telescopic booms commonly slide off of their guide rails and disable the boom.

Figure 13:
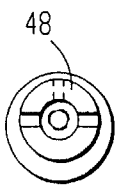
FIG. 13 is an end view of the first roller assembly wheel shown in FIG. 7 illustrating the eccentric shaft of the wheel.

Returning to the description of the present invention, the two uppermost wheels 38 and 40 of the first roller assembly 32 are preferably mounted on axles 48 having eccentric axes. As illustrated in FIG. 13, the axis of the eccentric axle 48 is slightly displaced from the geometric center of the axle 48. When the eccentric axle 48 is rotated, the position of the arcuate rail-engaging portion 50 is shifted relative to the arcuate wheel-engaging portions of the guide rails 22. This allows the uppermost wheels 38 and 40 of the first roller assembly 32 to be adjusted to properly align the guidance system. For example, if the rail-engaging portions 50 of the uppermost wheels 38 and 40 do not securely engage the wheel-engaging portions of the guide rails 22, the eccentric axles 48 of the two uppermost wheels 38 and 40 can be rotated to reposition the uppermost wheels 38 and 40 closer to the guide rails 22. Alternatively, if the uppermost wheels 38 and 40 are spaced too far apart from the lowermost wheels 42 and 44 to fit within the guide rails 22, the axles 48 of the two uppermost wheels 38 and 40 can be rotated the opposite direction to reposition the uppermost wheels 38 and 40.

In preferred forms, the wheels 38, 40, 42 and 44 are not attached to the axles 48 with fasteners or bolts, but are freely mounted thereto. Once the wheels 38, 40, 42 and 44 engage the guide rails, they are secured to the axles 48 by the guide rails 22. With this configuration, the wheels can be easily replaced and/or repaired by disengaging them from the guide rails 22 and simply removing them from the axles 48.

As best illustrated in FIG. 5, the second roller assembly 34 includes a support frame 54 attached to the distal end 16 of the outer boom 12 and pair of roller bars 56 and 58 rotatably mounted thereto. The roller bars 56 and 58 are configured for engaging the outer surface of the inner boom 14 during telescopic movement. As best illustrated in FIG. 5, the roller bars 56 and 58 preferably engage guide rails 22*a* secured to or integrally formed with the outer surface of the inner boom 14.

The support frame 54 includes a pair of elongated steel plates 60 extending vertically relative to the longitudinal axis of the outer boom 12. The steel plates 60 are attached to opposed sides of the distal end 16 of the outer boom 12 and include a plurality of slots 62 therein.

Figure 9:
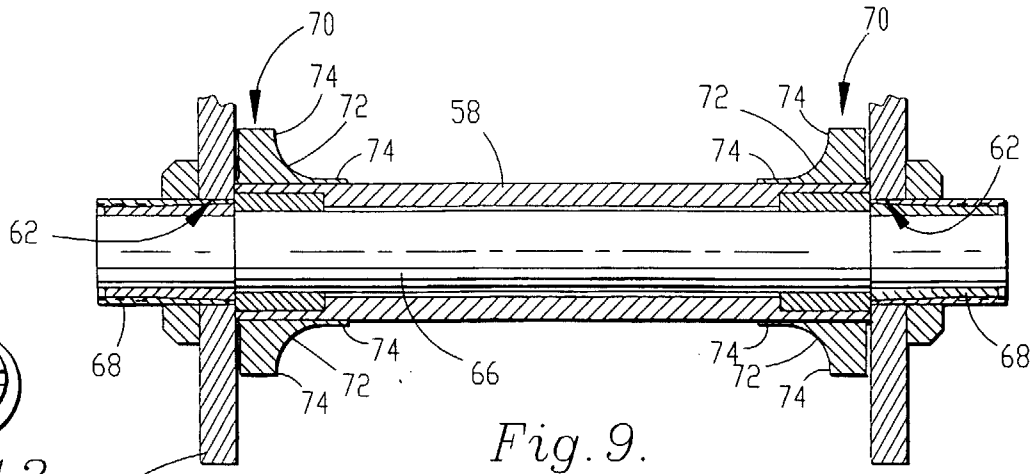
FIG. 9 is a sectional view of one of the roller bars of the second roller assembly mounted on a concentric shaft.
Figure 8:
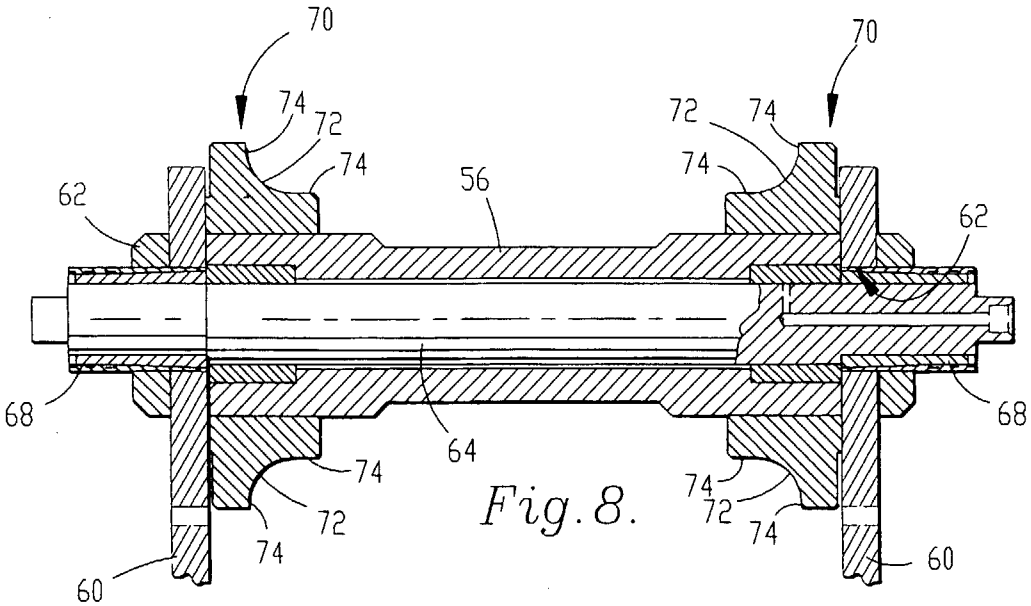
FIG. 8 is a sectional view of one of the roller bars of the second roller assembly mounted on an eccentric shaft.

As best illustrated in FIGS. 8 and 9, the roller bars 56 and 58 are rotatably mounted on a pair of shafts 64 and 66 extending through the slots 62 in the steel plates 60. A pair of conventional locking fasteners 68, such as the trantorque device manufactured by Fenner Manheim, are fastened to the ends of the shafts 64 and 66 for retaining the roller bars 56 and 58 on the shafts 64 and 66.

Each roller bar 56 and 58 includes a pair of axially opposed flange members 70 positioned on the ends of each of the shafts 64 and 66 for engaging the corners of the inner boom 14. Each of the flanges 70 includes an arcuate portion 72 for engaging the outside corners of the inner boom 14. The flanges 70 also include a generally annular lip portion 74 extending tangentially from the arcuate portion 72 for maintaining the engagement between the flange members 70 and the outside corners of the inner boom 14.

Figure 12:
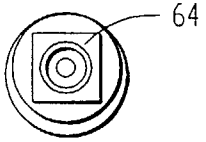
FIG. 12 is an end view of the roller bar shown in FIG. 8 illustrating the eccentric shaft of the roller bar.
Figure 11:
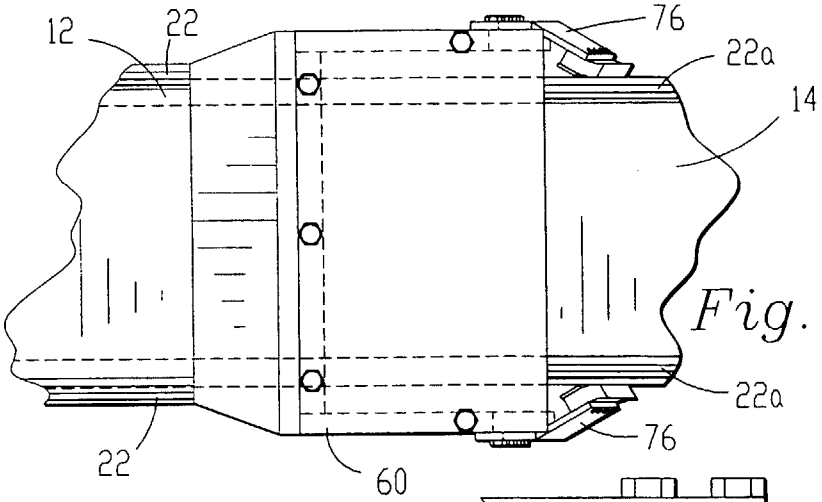
FIG. 11 is a top view of the boom illustrated in FIG. 10.
Figure 15:
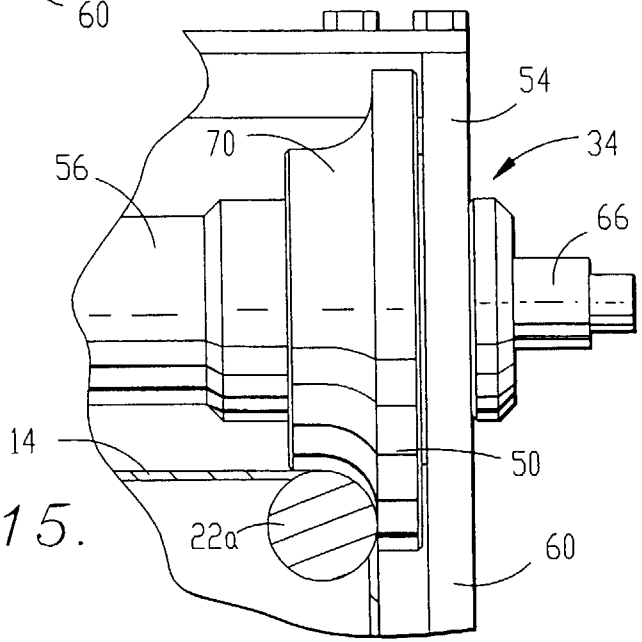
FIG. 15 is an enlarged front elevational view illustrating one end of a roller bar of the second roller assembly.
Figure 10:
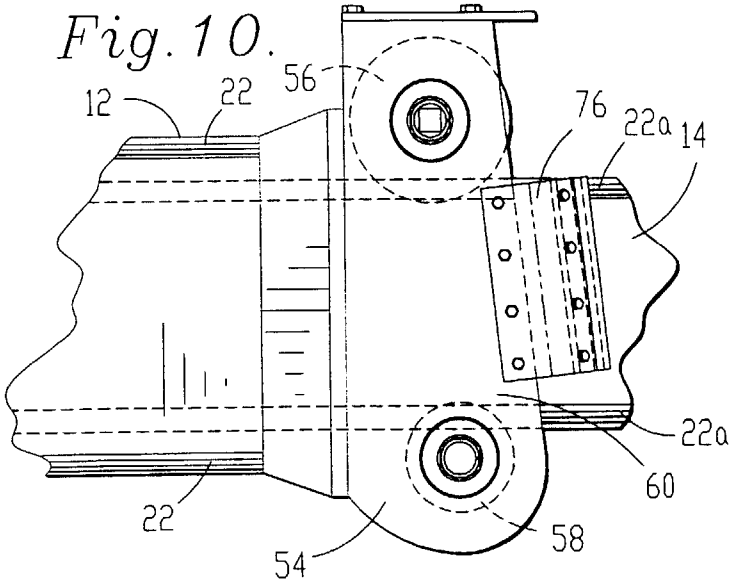
FIG. 10 is an enlarged side elevational view similar to FIG. 3 illustrating a portion of the second roller assembly.

In preferred forms, the uppermost roller bar 56 is rotatably mounted about a shaft having an eccentric axis. As illustrated in FIG. 12, the axis of the eccentric shaft 64 is slightly displaced from the geometric center of the shaft 64. With this configuration, the uppermost roller bar 56 can be repositioned about a vertical axis relative to the inner boom 14 by rotating the eccentric shaft 64. In particularly preferred forms, the telescopic boom is provided with a plurality of wiper assemblies 76 for removing rocks, dirt and other debris which accumulates on the inner boom 14 during use (see FIGS. 10 and 11). The wiper assemblies 76 include elongated rubber wiper blades bolted to the steel plates 60 of the second roller assembly 34. The wiper blades extend inwardly toward the inner boom 14 for removing debris from the boom.

In operation, the guidance system of the above described telescopic boom apparatus effectively maintains the telescopic engagement between the inner boom 14 and the outer boom 12 during axial telescopic movement. The wheels 38, 40, 42 and 44 of the first roller assembly 32 engage the guide rails 22 for guiding the proximal end 26 of the inner boom 14 along the axial length of the outer boom 12. The roller bars 56 and 58 of the second roller assembly 34 engage the outer surface of the distal end 24 of the inner boom 14 for guiding the inner boom 14 in and out of the outer boom 12.

If the guidance system of the telescopic boom apparatus must be adjusted during operation, the uppermost wheels 38 and 40 of the first roller assembly 32 and the uppermost roller bar 56 of the second roller assembly 34 can be rotated about their eccentric axes to reposition the guidance system relative to the inner and outer booms.

Although the invention has been described with reference to the preferred embodiment illustrated in the attached drawing figures, it is noted that equivalents may be employed and substitutions made herein without departing from the scope of the invention as recited in the claims. For example, although the inner and outer booms have been illustrated as presenting a rectangular cross section, they can be formed of a variety of shapes and sizes. Additionally, the quantity of wheels positioned on the first roller assembly and rollers positioned on the second roller assembly can be varied without departing from the scope of the invention.

Having thus described the preferred embodiment of the invention, what is claimed as new and desired to be protected by Letters Patent includes the following:

1. A telescopic boom apparatus comprising:

a elongated outer boom presenting opposed proximal and distal ends and a hollow passageway extending therebetween, the distal end presenting a cross sectional width;

an extensible inner boom telescopically received within said outer boom for axial telescoping movement in and out of the distal end of said outer boom, said inner boom having opposed proximal and distal ends; and guiding means for guiding said inner boom for axial telescoping movement in and out of the distal end of said outer boom, said guiding means including:

a first set of elongated guide rails secured within said outer boom passageway and extending parallel to the longitudinal axis of said outer boom, each of said first set guide rails presenting an arcuate track surface;

a plurality of roller wheels spaced circumferentially about the proximal end of said inner boom, each of said roller wheels including an arcuate rail engaging surface for engaging said track surfaces of said first set of guide rails during telescoping movement of said inner pole;

a second set of elongated guide rails secured to said inner boom; and a pair of roller bars secured to the distal end of said outer boom for engaging said second set of guide rails for guiding said inner boom during axial telescoping movement in and out of the distal end of said outer boom, said roller bars being positioned on opposed sides of the distal end of said outer boom and extending across substantially the entire cross sectional width of the distal end of said outer boom.

2. The telescopic boom as set forth in claim 1, at least one of said roller bars including an elongated shaft having an eccentric axis for permitting adjustment of the position of said roller bars for aligning said roller bars with said inner boom.

3. The telescopic boom as set forth in claim 1, said roller wheels each including an axle presenting an eccentric axis for permitting adjustment of the engagement of said roller wheels on said first set of guide rails.

* * * * *